US005965820A

United States Patent [19]

Ogawa

[11] Patent Number: 5,965,820

[45] Date of Patent: Oct. 12, 1999

[54] VIBRATIONAL PROCESSING APPARATUS AND METHOD

[75] Inventor: Mamoru Ogawa, Fukui-ken, Japan

[73] Assignee: Murata Manufacturing Co., Ltd., Japan

[21] Appl. No.: 08/965,825

[22] Filed: Nov. 7, 1997

Related U.S. Application Data

[62] Division of application No. 08/687,074, Jul. 15, 1996, Pat. No. 5,726,361.

[30] Foreign Application Priority Data

Jul. 14, 1995 [JP] Japan ..... 7-178839

[51] Int. Cl.[6] ..... C25D 17/16; C25D 17/26; C25D 17/10

[52] U.S. Cl. ..... 73/663; 204/222; 702/59

[58] Field of Search ..... 73/662, 663, 664, 73/579; 204/222, 223; 248/550; 364/508; 702/59, 103

[56] References Cited

U.S. PATENT DOCUMENTS

| | | | |
|---|---|---|---|
| 2,721,834 | 10/1955 | Koury | 204/222 |
| 3,862,745 | 1/1975 | Chiz | 204/222 |
| 4,545,884 | 10/1985 | Francis | 204/222 |
| 5,108,552 | 4/1992 | Desthomas | 204/198 |
| 5,348,637 | 9/1994 | Kobayashi et al. | 204/222 |

FOREIGN PATENT DOCUMENTS 5070999 3/1993 Japan .

OTHER PUBLICATIONS

"Linear Control Systems" by James L. Melsa and Donald G. Schultz (1969) Chapte 1—Introduction to Automatic Control Systems, pp. 1–7.

*Primary Examiner*—Hezron Williams
*Assistant Examiner*—Rose M. Miller
*Attorney, Agent, or Firm*—Ostrolenk, Faber, Gerb & Soffen, LLP

[57] ABSTRACT

In a plating apparatus 10, a known control signal for detection is supplied from a computer 50 to a motor 13 in advance; the motor 13 is rotated at a variable speed within a predetermined range; and the displacement of a basket 18 is detected by a displacement sensor 30 to obtain displacement characteristics data. Next, the computer 50 controls the rotating operation of the motor 13 through a motor controller 60 to put the basket 18 in a desired optimum state of vibration using the obtained displacement characteristics data and data of an optimum amplitude for the plating process obtained in advance.

2 Claims, 8 Drawing Sheets

FIG. 4(a)
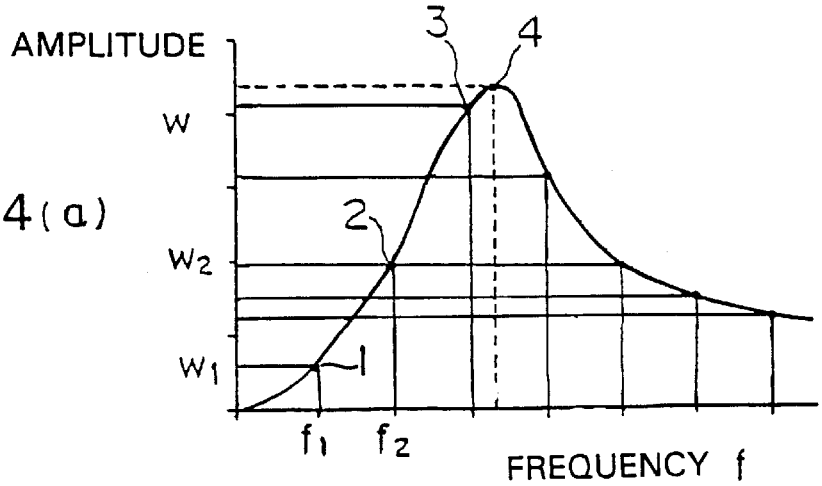
FIG. 4(b)
56
| f | W |
|---|---|
| $f_1$ | $W_1$ |
| $f_2$ | $W_2$ |
| $f_3$ | $W_3$ |
| $f_4$ | $W_4$ |
FIG.4(c)
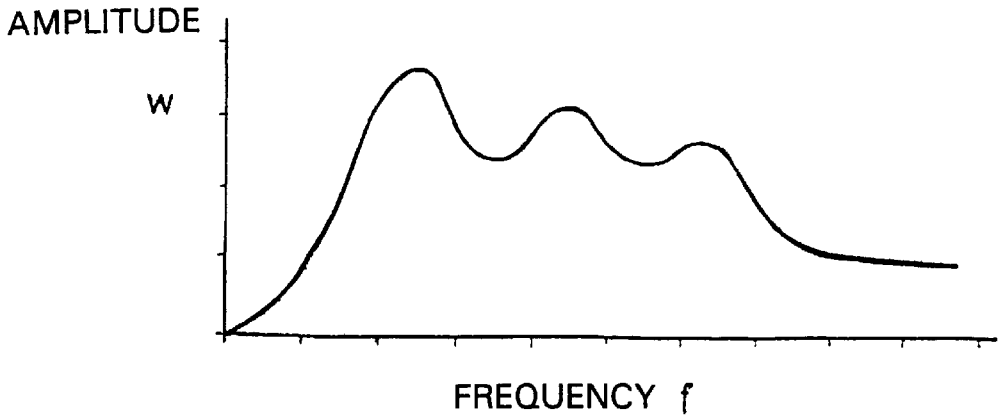

VIBRATIONAL PROCESSING APPARATUS AND METHOD

This is a Division of application Ser. No. 08/687,074, filed Jul. 15, 1996, now U.S. Pat. No. 5,726,361.

BACKGROUND OF THE INVENTION

1. Field of the Invention

The present invention relates to vibrational processing apparatus and methods including apparatus and methods for plating small electronic components such as laminated chip capacitors and including barrel-polishing apparatus for applying vibration to an object to be processed to perform processes such as plating and polishing thereon. More particularly, the present invention relates to a vibrational processing apparatus and method capable of controlling the state of vibration to optimize vibration applied to an object to be processed.

2. Description of the Related Art

FIG. 9 shows a structure of a plating apparatus as an example of conventional vibrational processing apparatus. For example, a plating apparatus as illustrated is disclosed in Japanese unexamined patent publication (KOKAI) No. H5-70999. This plating apparatus 1 includes a vibration generating portion 2, a vibration transfer member 7 for transferring vibrational energy generated by the vibration generation portion 2, and a basket 8 connected to the vibration transfer member 7 for containing an object to be plated such as a chip type electronic component. The basket 8 constitutes a negative electrode. A plating process is performed with the basket 8 immersed in a plating solution in a plating solution bath 9.

The vibrational generating portion 2 includes a motor 3. An eccentric load 4 is added to the rotating shaft of the motor 3. The motor 3 is mounted on a supporting frame 5 which is elastically supported on the bottom of a case through springs 6. With such a structure, rotation of the motor 3 causes periodic fluctuations of the balance between an eccentric force produced by the eccentric load 4 and an elastic supporting force provided by the springs 6, thereby causing a swinging motion of the supporting frame 5 as a whole. Then, vibrational energy is transferred to the basket 8 through the vibration transfer member 7 connected to the supporting frame 5 to cause the basket 8 to vibrate in the plating solution periodically. As a result, objects to be plated and steel balls or media placed in the basket 8 are agitated and mixed by the vibration of the basket 8. This allows the objects to be plated to be agitated in appropriate contact with the basket 8 and therefore allows formation of uniform plating films on the surface of the objects to be plated.

The rotational speed of the motor 3 of the conventional plating apparatus is set at a fixed value. Therefore, the vibrational energy which can be generated by the vibration generating portion 2 is fixed. However, the characteristic frequencies of vibrating portions including the basket 8 vary depending on the amount, size and weight of the objects to be plated and steel balls or media charged in the basket 8. This results in a change in the degree of the agitation of the objects to be plated in the basket 8. Therefore, even if the rotational speed of the motor 3 is preset so as to apply optimum vibration to the objects to be plated, it has been necessary to reset conditions such as the rotational speed of the motor 3 by detecting optimum vibrating conditions using detecting equipment or the like each time conditions of the objects to be plated or the like contained in the basket 8 are changed. Such an operation has required much time and labor, reducing the efficiency of a plating process. Further, there has been a problem in that the thickness of plating on an object to be plated can vary because of insufficient agitation of the object if the resetting of the rotating condition of the motor 3 and the like is not carried out.

Further, the problems as described above have occurred in conventional barrel polishing apparatus. Specifically, when polishing is performed by applying vibration to an object to be polished and an abradant or medium placed in the barrel pot, the state of vibration of the barrel pot varies if the size, weight, and quality of the object to be polished vary depending on the process. This has resulted in a problem in that much time and labor is required for resetting the optimum vibrating conditions.

It is an object of the present invention to provide a vibrational processing apparatus capable of applying the optimum vibrating conditions to an object to be processed even if processing conditions such as the size and quantity of the object to be processed are changed.

SUMMARY OF THE INVENTION

A vibrational processing apparatus according to the present invention includes a vibration generating means or unit for generating predetermined vibration, a vibratable element connected to the vibration generating means or unit for containing an object to be processed and for applying predetermined vibration to the object to be processed to effect a predetermined process by vibrating in response to the vibration generated by the vibration generating means or unit, a displacement detecting means or unit for detecting the vibrational displacement of the vibrated element, and a control means or unit. The control means or unit outputs a control signal to the vibration means or unit prior to the predetermined process to subject the vibratable element to vibration and to detect displacement of the vibratable element to obtain a displacement characteristics thereof and outputs a control signal to the vibration generating means or unit during the process to generate vibrations based upon the displacement characteristics to cause desired vibrational displacement of the vibrated element.

In a vibrational processing apparatus according to a limited aspect of the present invention, the vibratable element is characterized in that it includes a container which contains an object to be plated and is immersed in a plating solution and a transfer member connected to the container and vibration generating means for transferring vibration from the vibration generating means to the container.

Further, in a vibrational processing apparatus according to another limited aspect of the present invention, the vibratable element includes a container which contains an object to be polished and an abradant and vibrates in response to vibration from the vibration generating means.

In a vibrational processing method according to the present invention, the control unit is caused to output a control signal to the vibration generating unit prior to the predetermined process to subject the vibratable element to vibration. Displacement of the vibratable element is then detected to obtain displacement characteristics thereof. The optimum amplitude of vibration to be applied to the vibratable element is then determined from the displacement characteristics. A control signal is then applied from the control unit to the vibration generating unit in accordance with the previously determined optimum amplitude.

In one aspect of a method according to the present invention, the process is a plating method; in accordance with another aspect, the process is a polishing process.

BRIEF DESCRIPTION OF THE DRAWINGS

FIG. 4(*a*) illustrates displacement characteristics of a vibrated element detected by a displacement sensor 30.

FIG. 4(*b*) is a table showing the data of vibrational characteristics of the vibrated element obtained from the displacement characteristics.

FIG. 4(*c*) is a displacement characteristics diagram showing another example of displacement characteristics detected by the displacement sensor 30.

DETAILED DESCRIPTION OF THE PREFERRED EMBODIMENTS

Figure 1:
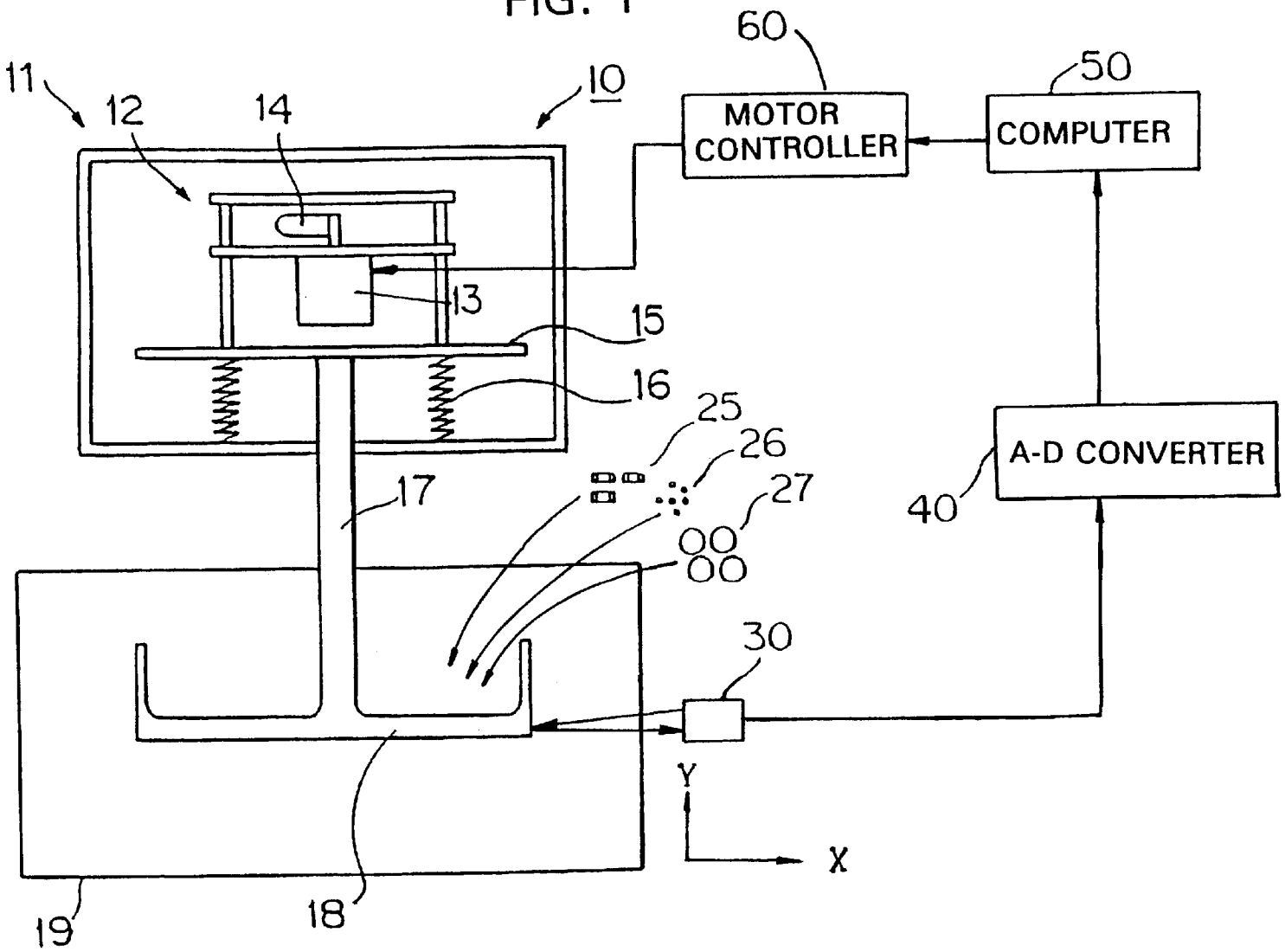
FIG. 1 illustrates a structure of a plating apparatus according to a first embodiment of the present invention.

FIG. 1 shows a sectional structure of a plating apparatus 10 according to a first embodiment of the present invention. The plating apparatus 10 includes a vibration generating portion or unit 11 for generating predetermined vibration, a vibration transfer member 17 for transferring the vibration generated by the vibration generating portion 11, a basket 18 which contains an object to be plated or the like and which serves as a negative electrode, a displacement sensor 30 and an A-D converter 40 for detecting vibrational displacement of the basket 18, a computer 50 and a motor controller 60 forming a control means or unit for controlling the state of the vibration generated at the vibration generating portion 11, and a plating solution bath 20 for storing a plating solution.

The vibration generating portion 11 includes a variable-speed motor 13 having an eccentric load 14 added to the rotational shaft thereof. The motor 13 is secured to a supporting frame 15. Further, the supporting frame 15 is elastically supported on the bottom of a case 12 through elastic springs 16. With such a configuration, the rotation of the motor 13 causes a periodic eccentric rotating motion of the eccentric load 14 about the rotational shaft of the motor 13. This results in periodic fluctuations of balance between an eccentric force produced by the eccentric load 14 and an elastic force provided by the elastic springs 16 and, consequently, in periodic swing of the supporting frame 15 relative to the bottom of the case 12.

The vibration transfer member 17 is constituted by a bar-shaped member which is secured to the bottom of the supporting frame 15 and which penetrates through and outwardly extends from the case 12. A basket 18 is secured to an end portion of the member 17. When the supporting frame 15 makes the swinging motion as described above, the end portion of the vibration transfer member 17 swings in conjunction with that motion. As a result, the same swinging motion as that of the supporting frame 15 is transferred to the basket 18.

The basket 18 is provided in the form of a mesh container which contains an object to be plated 25 such as a chip type electronic component or insulator particles 26 or steel balls 27 and is immersed in a plating solution in a plating solution bath 20 during a plating process. This basket 18 serves as a negative electrode during electrolytic plating.

The displacement sensor 30 detects displacement of the basket 18 and may be, for example, a laser type non-contact displacement sensor, CCD, acceleration sensor, or speed sensor. When a non-contact type displacement sensor is used as the displacement sensor 30, the displacement sensor is provided outside the plating solution bath 20. It is secured so that an appropriate position on the periphery of the basket 18 serves as a position for detecting displacement. When it is difficult to use the peripheral surface of the basket 18 as the detecting position of the sensor, the displacement sensor 30 may be disposed so that a surface of the vibration transfer member 17 exposed above the plating solution bath 20 serves as the position for detecting displacement. Further, when an acceleration sensor or speed sensor is used, such a sensor must be disposed on the basket 18 or vibration transfer member 17.

The A-D converter 40 receives an analog signal corresponding to the displacement detected by the displacement sensor 30 and converts it into a digital signal which is outputted to the computer 50.

The computer 50 controls plating operations of the plating apparatus 10, especially, the operation of the vibration generating portion 11. This control operation will be described later in detail.

The motor controller 60 receives a control signal from the computer 50 and outputs a control signal to the motor 13 for controlling the rotational speed of the motor 13.

Figure 2:
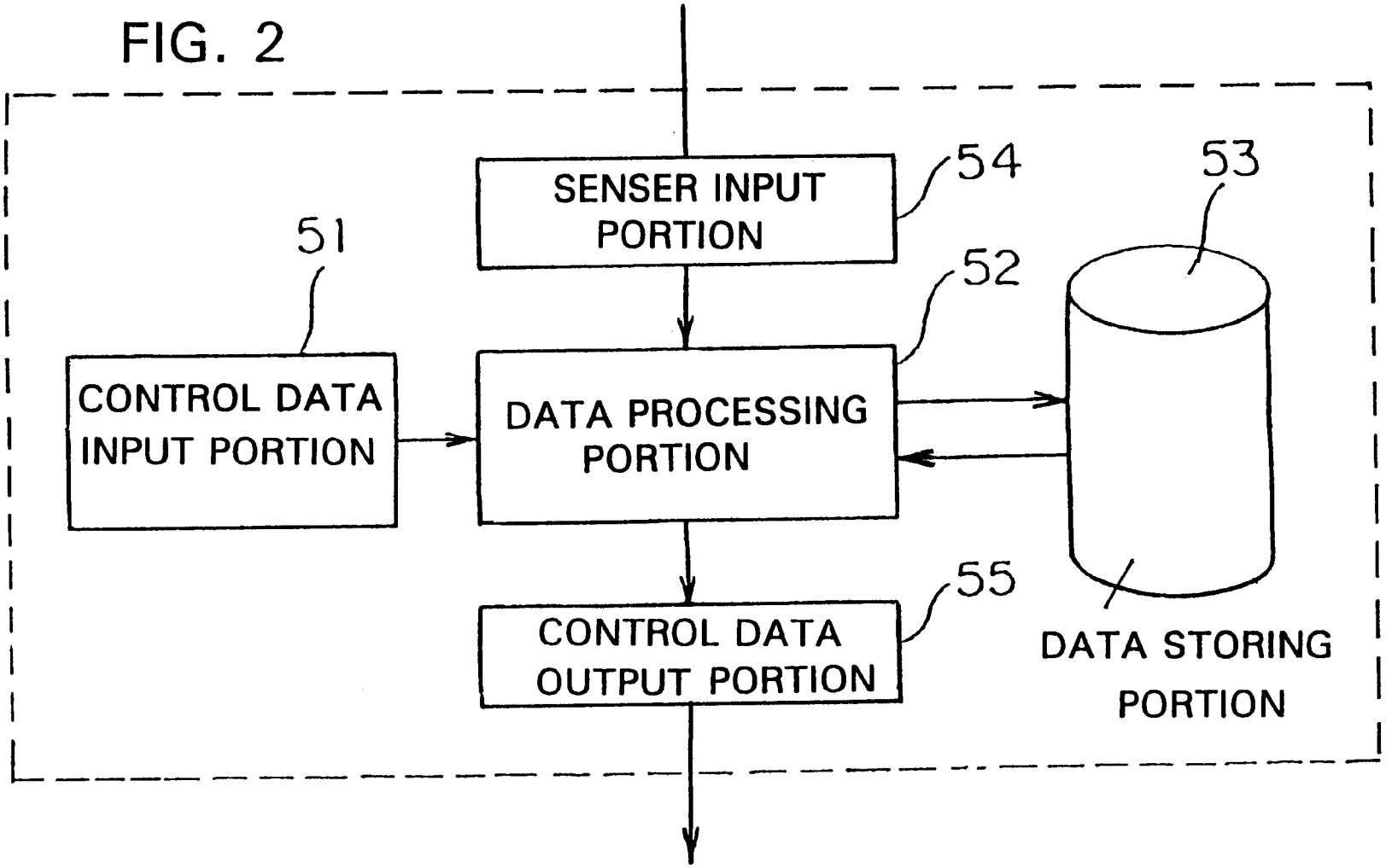
FIG. 2 is a functional block diagram of a computer 50 of the plating apparatus shown in FIG. 1.
Figure 3:
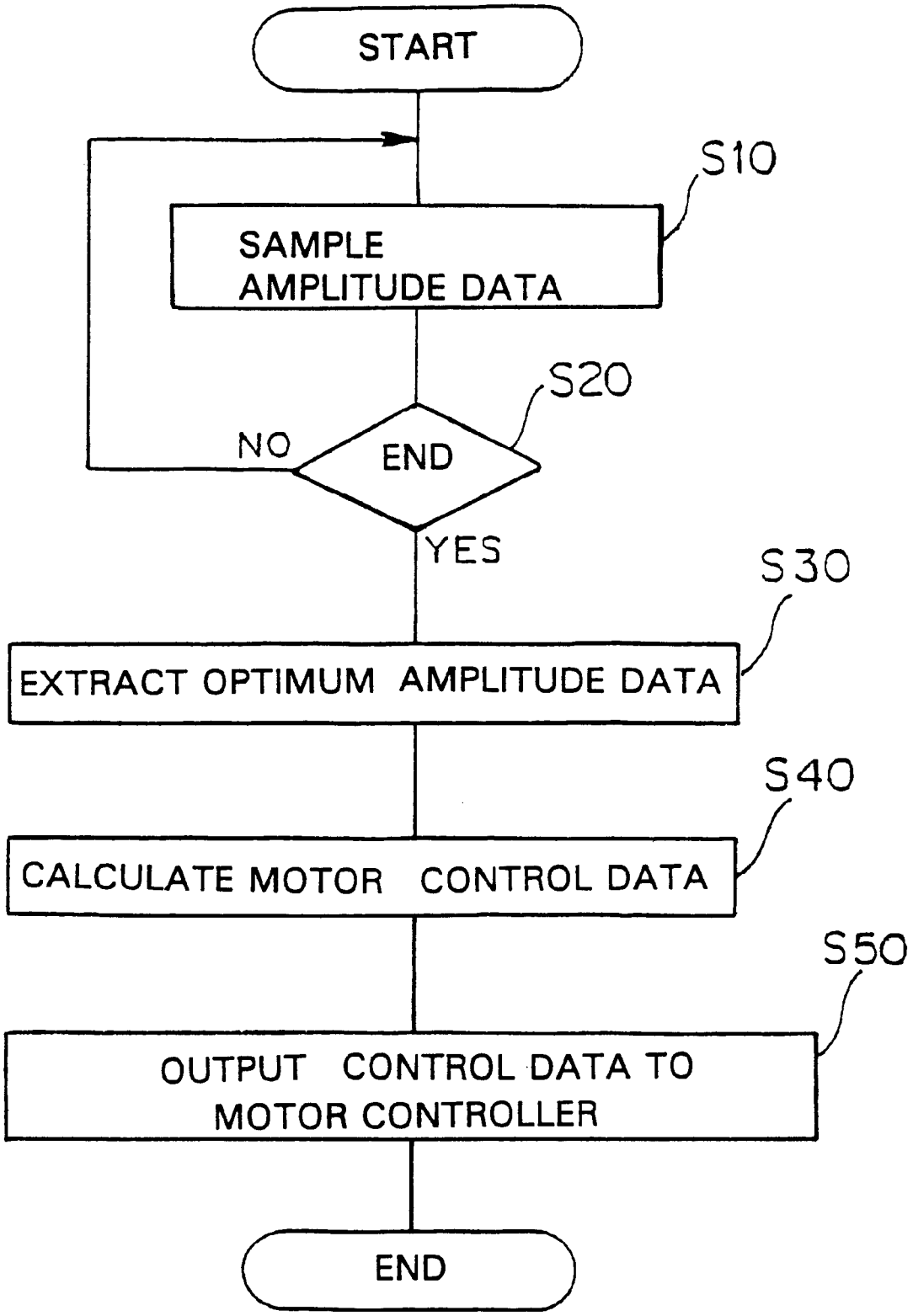
FIG. 3 is a flow chart showing a processing operation of the computer 50.

The operation of the plating apparatus having the above-described configuration will now be described. The operation of this plating apparatus 10 is controlled by the computer 50. FIG. 2 illustrates a configuration associated with the control operation of the computer using a functional block diagram, and FIG. 3 illustrates the control operation using a flow chart. The following description will be made with reference to FIGS. 2 and 3.

According to a functional representation of the configuration of the computer 50 associated with the operation of controlling the plating apparatus, the computer 50 is constituted by a control data input portion 51, a data processing portion 52, a data storing portion 53, a sensor input portion 54, and a control data output portion 55. For example, the control data input portion 51 is constituted by an input apparatus such as a keyboard; the data processing portion 52 is constituted by a CPU (central processing unit); and the data storing portion 53 is constituted by a memory such as a hard disc. Further, the sensor input portion 54 and control data output portion 55 are constituted by an input/output interface or the like.

The plating operation of the plating apparatus 10 includes two modes of operation, i.e., a displacement detection mode for detecting vibrational displacement characteristics of the plating apparatus and a plating process mode for performing a plating process by applying optimum vibration based on the detected displacement characteristics.

First, in the displacement detection mode, as shown in FIG. 3, a process for sampling amplitude data is performed (step 10). Specifically, an object to be plated 25, insulating particles 26, and steel balls 27 are placed in the basket 18 and are immersed in the plating solution bath 27. In this state, the data processing portion 52 of the computer 50 outputs rotational speed control data to the motor controller 60 through the control data output portion 55 to constantly change the rotational speed of the motor 13 from a low speed to a high speed. The motor controller 60 outputs a control signal to the motor 13 in accordance with the rotational speed control data to cause the motor 13 to operate continuously at the low speed through high speed. This results in vibration of the basket 18 the state of which varies in accordance with the change in the rotational speed of the motor 13.

At the same time, the displacement sensor 30 detects the displacement of the basket 18. In this case, a laser type non-contact displacement sensor is used as the displacement sensor 30, and the vibrational displacement of the basket 18 is detected as one-dimensional displacement in the X-direction in FIG. 1.

FIG. 4(*a*) shows the displacement of the basket 18 detected by the displacement sensor 30 in terms of an amplitude W. The horizontal axis of the graph in FIG. 4(*a*) represents the vibration frequency of the basket 18 relative to the change in the rotational speed of the motor 13. It is apparent from FIG. 4(*a*) that the structure of the basket 18 containing vibrated portions of the plating apparatus 10, i.e., the vibration generating portion 11, the vibration transfer member 17, and the object to be plated and the like has a primary resonance point 4.

FIG. 4(*c*) shows the relationship between the frequency and amplitude in a case wherein the vibrational structure has not only the primary resonance point but also secondary and tertiary resonance points. The analog data of the amplitude W of the basket 18 is sampled by the A-D converter 40 at constant time intervals, converted into digital data ($W_1$, $W_2$), and then inputted to the data processing portion 52 through the sensor input portion 54 of the computer 50.

The data processing portion 52 receives the displacement data from the displacement sensor 30 and generates the data of the displacement characteristics of the plating apparatus 10.

FIG. 4(*b*) conceptually illustrates this displacement characteristics data 56 in the form of a table. The displacement characteristics data 56 is constituted by a combination of the frequency f of vibration corresponding to the rotational speed of the motor 13 and the corresponding amplitude W of the basket 18.

The amplitude data sampling process as described above is continuously performed until the motor 13 reaches a predetermined rotational speed. After a predetermined sampling process, the displacement characteristics data 56 as described above is stored in the data storing portion 53, and this terminates the sampling process (FIG. 3, step 20).

Next, the actual plating process is performed. For example, the operator of the plating apparatus inputs instructions for the plating process and various data on the plating conditions to the computer 50 through the control data input portion 51. As the conditions for the plating process, it is sufficient if conditions required for calculating the rotational speed of the motor 13 for causing the optimum vibrational displacement (amplitude) at the basket 18 and consequently the object to be plated are inputted. For example, the type, charged amount, and the quality of the object to be plated and the diameter and charged amount of the steel balls are inputted. Further, standard optimum amplitude data corresponding to various plating conditions are stored in advance in the data storing portion 53. As an example, referring to FIG. 5, identification types 57*a* identifying various vibrating conditions and a combination of optimum amplitude data 57*b* and vibration duration 57*c* for each identification type are set in the optimum amplitude data table 57. In this example, the operation of the motor 13 is controlled so that vibration having a predetermined optimum amplitude W is applied for time t for various plating conditions.

Figure 5:
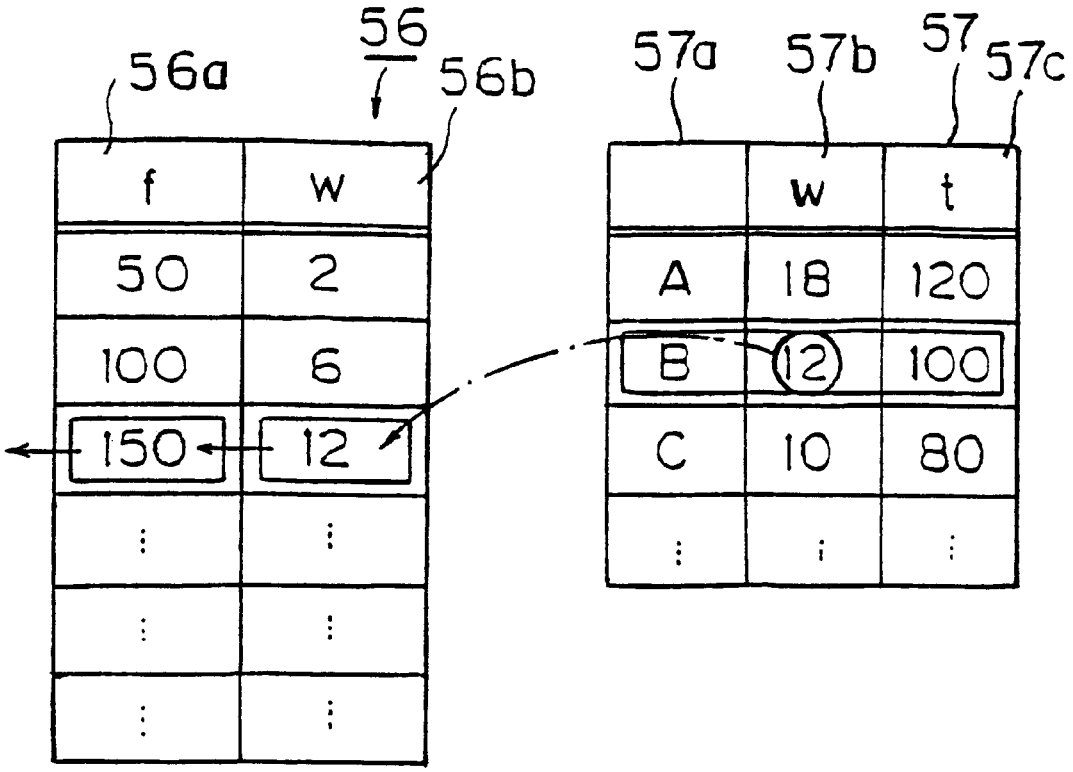
FIG. 5 illustrates an operation of calculating optimum amplitude data performed by a data processing portion 52 of the computer 50.

When the data of a plating condition is inputted from the control data input portion 51, the data processing portion 52 determines the identification type of the vibrating condition corresponding to the input data and refers to the optimum amplitude data table 57 stored in the data storing portion 53 to detect the optimum amplitude data W and process duration t corresponding to the input plating condition. For example, if the identification type is determined as "B" from the input plating condition as shown in FIG. 5, the optimum amplitude W (=12) and processing time t (=100) are extracted from the optimum amplitude data table 57 (FIG. 3, step 30).

Next, the data processing portion 52 calculates data to be supplied to the motor 53 using the extracted optimum amplitude data W and processing time t with reference to the displacement characteristics data table 56 which has already been obtained using sampling. Specifically, the amplitude data column 56*b* of the displacement characteristics data table 56 is looked up using the optimum amplitude data W extracted by the above-described process to detect the data which matches. In the illustrated case, since the match occurs at the point of the amplitude W=12, a frequency f (=150) stored in association with that amplitude W is extracted from the displacement characteristics data table 56.

Figure 6:
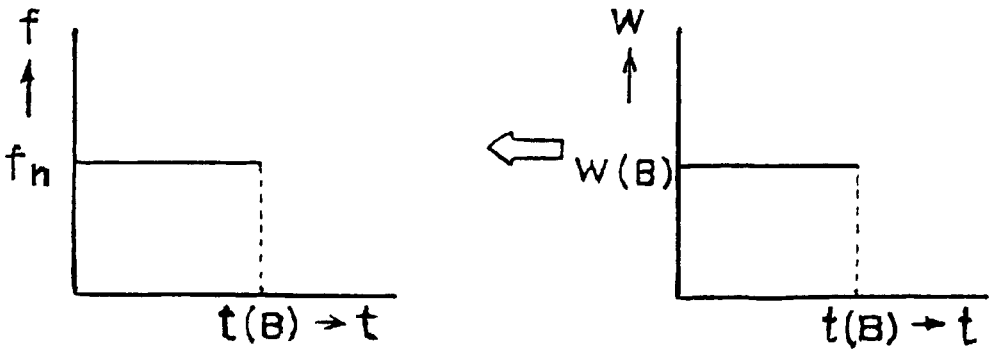
FIG. 6 illustrates the relationship between detected processing time and amplitude and between calculated processing time and frequency.

FIG. 6 illustrates the relationship between the detected processing time t and amplitude data W and between the calculated processing time t and frequency data f. The data processing portion 52 further converts the calculated frequency f into motor rotational speed data. Through such a process, a motor rotational speed and processing time t (=100) are calculated as control data for the motor 13 (step 40).

The calculated control data for the motor 13 is outputted to the motor controller 60. The motor controller 60 controls the rotation of the motor 13 based on this control data (FIG. 3, step 50).

The above-described control allows the motor 13 to rotate at the optimum rotational speed for a predetermined period of time. As a result, the basket 18 vibrates at the optimum amplitude to form a plating film on the object to be plated while agitating and mixing the same. The specific values of the optimum amplitude W, frequency f, and processing time t given in the above description are only illustrative.

As described above, the plating apparatus 10 according to the present invention is configured to control the rotational speed of the motor 13 so as to achieve the optimum state of vibration with the vibration characteristics of the vibrated element detected in advance. Therefore, the optimum state of vibration can be easily obtained even if the type, quantity and the like of the object to be plated vary. This makes it possible to form a uniform plating film on an object to be plated.

The method of controlling the rotational speed of the motor 13 is not limited to that for maintaining constant rotation as described above, and various methods of control may be employed as needed. For example, as shown in FIG.

7(*a*), the rotational speed of the motor 13 may be varied to cause a stepwise change in the amplitude of the basket 18 from that in the initial stage. In this case, for example, a plurality of combinations of amplitude data 57*b* and processing time 57*c* may be stored for a single identification type in the optimum amplitude data table 57 shown in FIG. 5.

Figure 7:
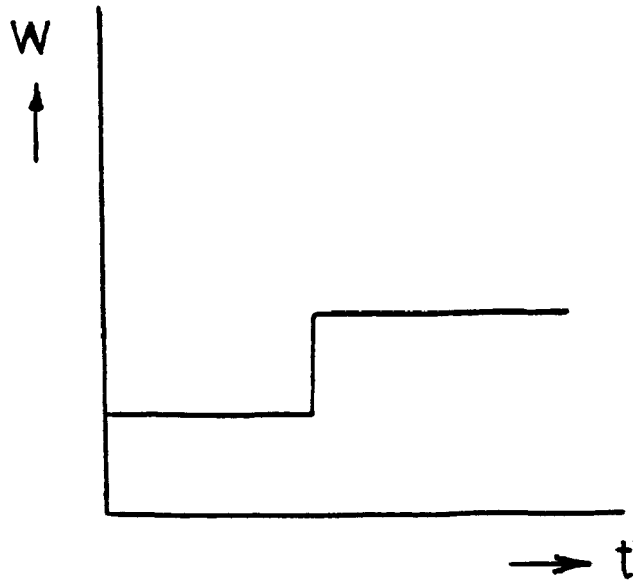
FIGS. 7(*a*) and 7(*b*) are illustrations of data showing other examples of optimum amplitude data controlled by the computer 50.
Figure 7:
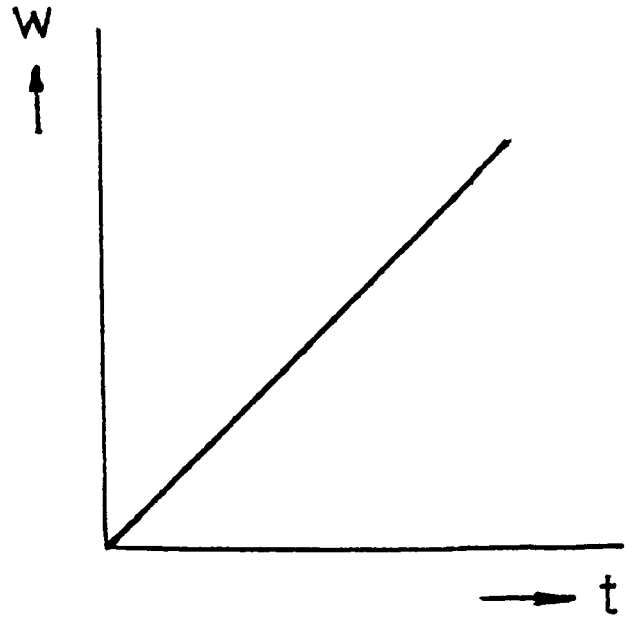

Further, as shown in FIG. 7(*b*) the rotational speed of the motor 13 may be varied so that the amplitude of the basket 18 increases as time passes.

The method of calculating the data for controlling the rotational speed of the motor 13 from the displacement characteristics of the basket 18 is not limited to that described above with reference to FIG. 5, and various methods which can be implemented on a software basis may be employed.

In addition, various other configurations may be employed for each of the above-described components that form the plating apparatus 10. For example, the motor 13 and eccentric load 14 serving as a vibration source may be configured using a vibration source having a vibrating element utilizing a piezoelectric effect or a vibration source wherein a mass element is electromagnetically reciprocatively vibrated. When the former vibration source is used, the control signal from the computer 50 will be a signal for varying the voltage level applied to a piezoelectric element. In the latter case, the control signal will be a signal for varying the cycle and amplitude of the movement of the mass element.

Further, a CCD may be used as the displacement sensor 30, as described above. In this case, a mark is provided in the center of the basket 18; the locus of the movement of the mark in a predetermined period of time is inputted to and kept in a video memory to store the amplitude data. Then, the stored image data may be converted into a binary form to obtain the amplitude of the mark, i.e., the amplitude of the basket through predetermined calculations. In this case, it is possible to obtain the amplitude of the vibration of the basket on a two-dimensional basis.

Moreover, the displacement sensor 30 may be provided in three-dimensional directions to detect the displacement of the basket 18 as three-dimensional data. This is advantageous especially when the vibration source can provide arbitrary vibrations in the three-dimensional directions independently.

In addition to the effect of optimum vibration control during a plating process as described above, the above-described plating apparatus 10 is capable of predicting, for example, the occurrence of the breakdown of the vibration transfer member 17 and the like due to fatigue. Specifically, the data of the natural frequency characteristics of the vibration system of the plating apparatus 10 is detected during the amplitude data sampling process using the displacement sensor 30. Therefore, if this data of the natural vibration characteristics is maintained, a change in the natural vibration caused by, for example, a crack in the vibration transfer member 17 due to fatigue can be compared with the data of the natural vibration characteristics maintained to detect the occurrence of the breakdown due to fatigue.

Figure 8:
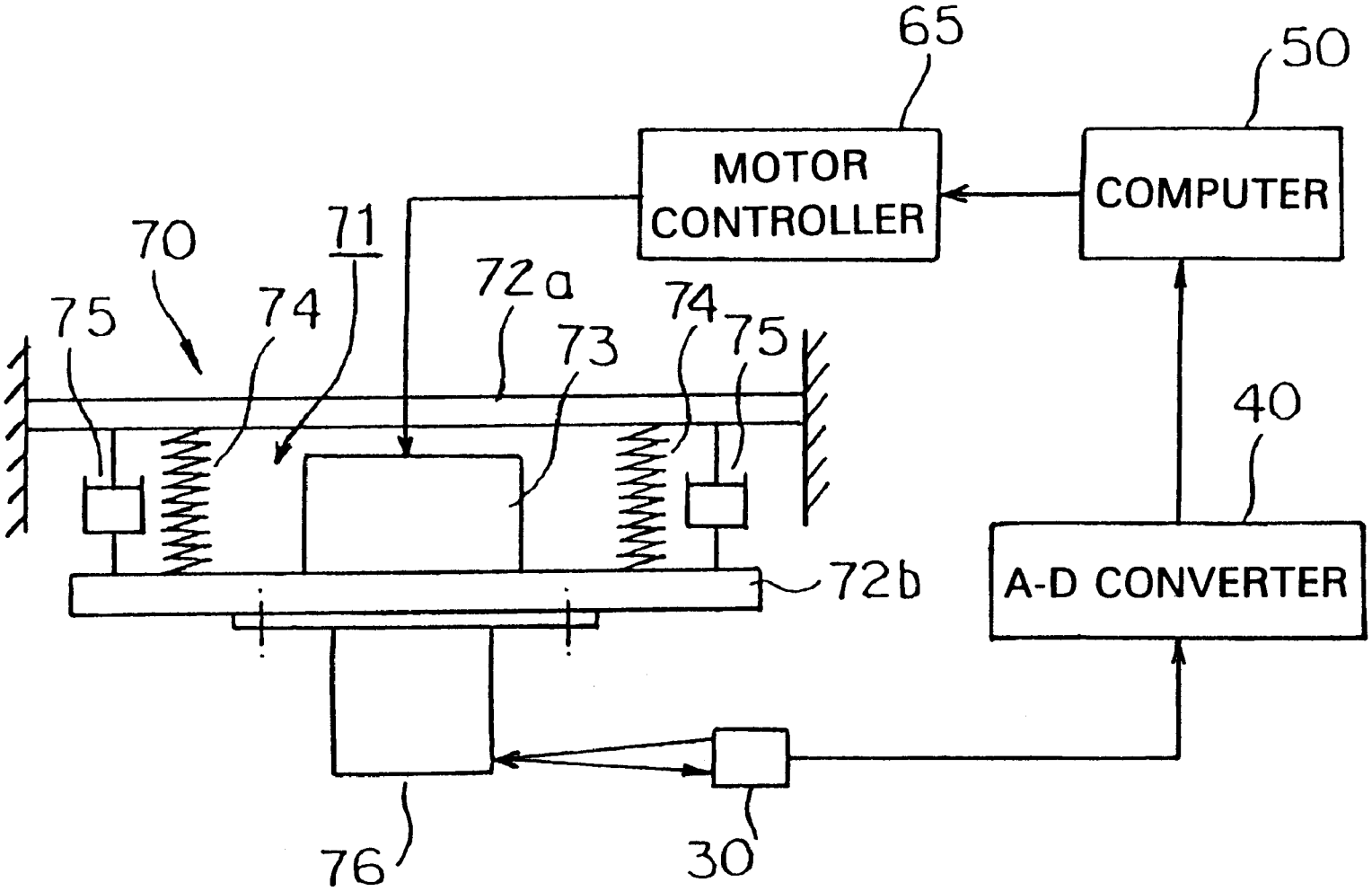
FIG. 8 shows a structure of a barrel polishing apparatus according to a second embodiment of the present invention.
Figure 9:
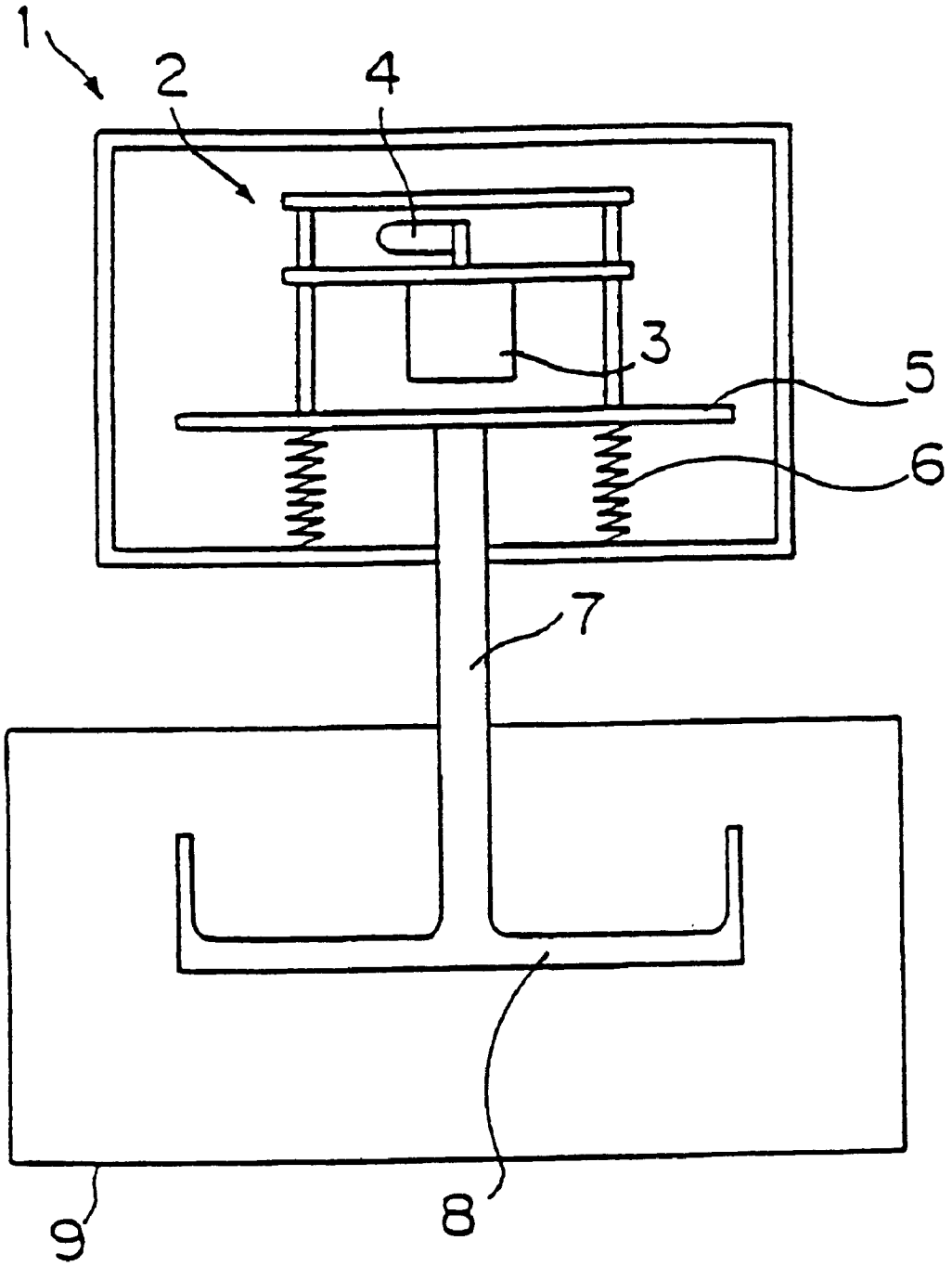
FIG. 9 shows a structure of a conventional plating apparatus.

FIG. 8 shows a structure of a barrel polishing apparatus according to a second embodiment of the present invention. The barrel polishing apparatus 70 is an apparatus which includes a vibration generating portion 71, a barrel pot 76, a displacement sensor 30, an A-D converter 40, a computer 50, and a controller 65 and which polishes an object to be polished by agitating and mixing the object to be polished and an abradant, medium or the like contained therein.

The vibration generating portion 71 is formed by a vibrator 73 serving as a vibration source, a supporting frame 72*b* for supporting the vibrator 73, a fixing frame 72*a*, and elastic springs 74 and dash pots 75 interposed between the supporting frame 72*b* and fixing frame 72*a*. The vibrator 73 may be provided using a combination of a motor 13 and an eccentric load 14 as in the above-described first embodiment, or a vibration source utilizing a piezoelectric effect, or an electromagnetic vibration source. Referring to the mode of vibration, the structure is preferably capable of providing not only one-dimensional vibration but also two-dimensional or three-dimensional vibration.

The barrel pot 76 is formed like a hollow cylinder and is mounted on the underside of the supporting frame 72(*b*). During a polishing process, it contains chip type electronic components or the like, and a medium such as alumina powder and cobble stones.

The displacement sensor 30 is fixed in a position wherein it can detect vibrational displacement of the barrel pot 76. As in the plating apparatus in the first embodiment, a non-contact type displacement sensor, acceleration sensor, or speed sensor may be used as this displacement sensor 30.

Further, the configurations of the A-D converter 40, computer 50, and controller 65 are the same as those in the above-described plating apparatus and will not be described here because they will be apparent from the description of the same.

Referring to the operation of the barrel polishing apparatus 70, a process of sampling vibrational displacement of the barrel pot 76 is first performed to detect displacement characteristics data. Then, the optimum vibrating condition for the processing condition for the polishing process to be performed is calculated with reference to the obtained displacement characteristics data, and vibration is generated by the vibrator 73 based on the vibrating condition to vibrate the barrel pot 76, thereby effecting a polishing process on the object to be polished.

In the case of a polishing process to eliminate flash at the corners of a chip type electronic component or the like, chips and cracks can be produced at the corners of the component if vibration having a great amplitude in the vicinity of the resonance point of the vibrator is suddenly applied at the initial stage of the process because the corners of the component are sharp in such a stage. Therefore, the vibration of the vibrator 73 is initially controlled so as to vibrate the barrel pot 76 with a small amplitude, and vibration in the vicinity of the resonance point of the vibrator is applied to increase the amplitude when a certain period of time has passed. Such control over the vibrating operation of the vibrator 73 allows barrel polishing to be performed efficiently in a short period of time.

In this barrel polishing apparatus, it is also possible to control the vibration of the vibrator 73 to provide an arbitrary mode. Specifically, the vibration frequency of the vibrator 73 can be kept constant or varied in the form of a step or ramp over time.

Further, by storing the natural vibration characteristics of the vibrator detected by the displacement sensor 30 during the process of sampling vibrational displacement, the occurrence of a defect due to the fatigue of the vibrator or the like can be detected through comparison of such characteristics.

As described above, a vibrational processing apparatus according to the present invention has a configuration including a displacement detecting means wherein the displacement characteristics of a vibrated element are detected in advance prior to actual processing and wherein vibration generated by a vibrating means is controlled utilizing the displacement characteristics so that the vibrated element is put in optimum state of vibration. As a result, optimum vibration can be applied to an object to be processed to perform a predetermined process efficiently even if various processing conditions for the object to be processed vary.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method of vibrational processing using vibrational processing apparatus including a vibration generating unit for generating predetermined vibration, a vibratable element connected to said vibration generating unit for containing an object to be processed and for applying vibration to said object to be processed, a displacement detecting unit for detecting vibrational displacement of said vibratable element, and a first control unit for outputting a control signal to said vibrational generating unit, the method comprising the steps of:

a) causing said control unit to output a control signal to said vibration generating unit prior to a plating process to subject said vibratable element to vibration;

b) detecting displacement of said vibratable element to obtain displacement characteristics thereof;

c) determining the optimum amplitude of vibration to be applied to said vibratable element from said displacement characteristics; and d) applying a second control signal from said control unit to said vibration generating unit in accordance with the optimum amplitude determined in step c).

2. A method of vibrational processing using vibrational processing apparatus including a vibration generating unit for generating predetermined vibration, a vibratable element connected to said vibration generating unit for containing an object to be processed and for applying vibration to said object to be processed, a displacement detecting unit for detecting vibrational displacement of said vibratable element, and a first control unit for outputting a control signal to said vibrational generating unit, the method comprising the steps of:

a) causing said control unit to output a control signal to said vibration generating unit prior to a polishing process to subject said vibratable element to vibration;

b) detecting displacement of said vibratable element to obtain displacement characteristics thereof;

c) determining the optimum amplitude of vibration to be applied to said vibratable element from said displacement characteristics; and d) applying a second control signal from said control unit to said vibration generating unit in accordance with the optimum amplitude determined in step c).

* * * * *